US005645396A

United States Patent [19]

Romanowski

[11] Patent Number: 5,645,396

[45] Date of Patent: Jul. 8, 1997

[54] PRINTER MAILBOX SETS ACCESS AND REMOVAL SYSTEM

[75] Inventor: Robert F. Romanowski, Rochester, N.Y.

[73] Assignee: Xerox Corporation, Stamford, Conn.

[21] Appl. No.: 637,514

[22] Filed: Apr. 25, 1996

[51] Int. Cl.[6] ..... B65H 31/30

[52] U.S. Cl. ..... 414/789.9; 109/73; 414/790.3

[58] Field of Search ..... 232/27, 43.3, 43.4, 232/53; 271/298; 355/321, 322, 323; 414/269, 270, 272, 789.9, 790.3; 109/73

[56] References Cited

U.S. PATENT DOCUMENTS

| | | | |
|---|---|---|---|
| 4,190,247 | 2/1980 | Guenther | 271/291 |
| 4,376,529 | 3/1983 | George et al. | 270/53 |
| 5,308,058 | 5/1994 | Mandel et al. | 271/297 |
| 5,328,170 | 7/1994 | Coombs et al. | 271/297 |

OTHER PUBLICATIONS

Xerox Disclosure Journal, vol. 18, No. 6, Nov./Dec. 1993, pp. 619–624 Author: W. Kramer.

*Primary Examiner*—Karen B. Merritt
*Assistant Examiner*—Janice L. Krizek

[57] ABSTRACT

In a printer mailboxing system with an array of multiple locked mailbox bins in which printed sheet print jobs from a printer are stacked into respective mailbox bins selectively designated for different users of the printer, which mailbox bins have access doors which are selectively electrically unlockable to provide print job removal access for the respective user; an integral print job removal system is provided for the mailbox bins, and the respective access door and its integral print job removal system are mounted to pivotally swing out together substantially horizontally away from the array of bins when that bin is unlocked, to pivot all the print jobs in that bin out away from the array of bins for improved access and removal, while still supporting the print jobs, but exposing the print jobs on two orthogonal sides, with the access door opening on two orthogonal sides.

6 Claims, 5 Drawing Sheets

PRINTER MAILBOX SETS ACCESS AND REMOVAL SYSTEM

Cross-reference is made to a copending commonly assigned application, filed Jan. 11, 1996 as U.S. application Ser. No. 08/586,473, by Paul F. Morgan, et al, entitled "Mailbox Bin Job Set Extractor", Attorney Docket No. D/94867.

Disclosed in the embodiment herein is an improved system for accessing and removing print jobs of printed sheets from individual mailbox bins of an array of mailbox bins in a printer mailboxing system, particularly for such a printer mailboxing system in which individual bins are automatically electronically unlocked for access by designated users.

The above cross-referenced co-pending and commonly assigned application is of particular interest for its disclosure of a linearly movable set extractor for extracting printed job sets from unlocked mailbox system bins. It addresses some of the problems for which the present application provides alternative solutions.

Further by way of background on the subject of printer mailbox systems, and particularly those with security access doors and automatic electrical access door unlatching and/or bin opening systems, is Xerox Corporation U.S. Pat. No. 5,308,058 issued May 3, 1994 to Barry P. Mandel, et al, and other art cited and discussed therein.

Noted on the subject of a sorter with an array of locked drawers or bins which may be unlocked to slide out, is U.S. Pat. No. 5,328,170 issued Jul. 12, 1994 to Peter M. Coombs, et al, assigned to Gradco (Japan) Ltd., and Ricoh Japanese Utility Model Publication No. 62-95373 of Jun. 18, 1987. An additional secured or locked array of bins system with a slide out drawers mechanism is shown in Xerox Disclosure Vol. 18, No. 6, November/December, 1993, pages 619–624.

On the subject of pivoting softer bins, not for a mailbox system, there is noted Xerox Corporation U.S. Pat. No. 4,376,529 issued Mar. 15, 1983 to Clifford L. George, et al, and U.S. Pat. No. 4,190,247 issued Feb. 26, 1980 to Joachim Guenther.

As noted in some of the cited mailbox references, printer mailbox systems do not operate like sorters. They provide one or more assignable, designated or selected discrete mailbox bins for designated users for their printed sheets output from a shared users printer. Thus, the print jobs of different users can be separated into different bins for different users, and optionally locked therein. This is completely different from "sorting" in the usual sense of collating plural identical copy sheets by sequentially placing one such sheet at a time in a different bin, and then repeating those steps for each different copy sheet, to end up with one identical collated copy set in each bin.

To provide mailbox job security and privacy requires restricting manual access to the mailbox bins to prevent unauthorized reading or removal of the job sets in that bin until that bin is unlocked by or for that user. As shown and described in the above references, this bin unlocking is preferably by controlled selective electric unlatching of bins in response to a code entry when that particular user or a systems administrator wishes to remove print jobs from assigned mailbox bins, so that the bins may otherwise remain locked to protect their contents.

The construction of mailbox bins with sufficient access restriction when locked, however, makes the removal of the job sets therein much more difficult when the bin is unlocked. That is particularly the case for undersized sheets, since the bin must be designed to accommodate accumulating sheets of various sizes, including larger sheets. Smaller sheets may thus be stacked well into the interior of the mailbox bin, and thus require extraction from the bin interior. Requiring the operator to manually reach a substantial distance into the bin to remove sheets, especially through a restricted access opening, is not desirable. It is greatly preferable for all the sheets in the bin to be both visible and readily accessible for removal whenever the bin is unlocked. The embodiment disclosed herein provides substantial improvements in that respect.

A specific feature of the specific embodiment disclosed herein is to provide, in a printer mailboxing system with an array of multiple locked mailbox bins in which printed sheet print jobs from a printer are stacked into respective mailbox bins selectively designated for different respective users of the printer, which mailbox bins are selectively electrically unlockable to provide frontal access for the respective users to their respective mailbox bins for removal of their print jobs from their respective mailbox bins, each mailbox bin having an access door and a printed sheet stacking and supporting surface, the improvement comprising: providing an integral print job removal system for the mailbox bins; and individually frontally pivotally mounting the access door and the print job removal system so that the access door and the integral print job removal system of an individual mailbox bin freely pivotally swings out away from the array of multiple mailbox bins when the mailbox bin is electrically unlocked, to pivot all the print jobs in the bin out away from the array of multiple mailbox bins for improved access and removal of the print jobs from the mailbox bin.

Further specific features disclosed herein, individually or in combination, include those wherein the print job removal system comprises at least a portion of the printed sheet stacking and supporting surface of the mailbox bin which is operatively connected to pivot with the access door; and/or the pivotally mounting of the access door and the print job removal system of the mailbox bins is on a substantially vertical common axis of rotation adjacent one frontal corner of the access door to provide substantially horizontal outward rotation thereof; and/or the print job removal system of the mailbox bins includes vertically extending sheet stack extracting surfaces normally spaced adjacent at least one side of the mailbox opposite from the access door; and/or wherein the access door includes two orthogonal sides of the mailbox bin and/or is L-shaped; and/or wherein the access door and the print job removal system of the mailbox bins are spring loaded to automatically partially pivot open from the array of mailbox bins when the mailbox bin is electrically unlocked.

The disclosed system may be operated and controlled by appropriate operation of conventional control systems. It is well known and preferable to program and execute imaging, printing, paper handling, and other control functions and logic with signals from software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. The resultant controller signals may conventionally actuate various conventional electrical solenoid or cam-controlled sheet deflector fingers, motors or clutches, or other components, in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders and gates, etc., as is well known in the art.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of a specific embodiment, including the drawing figures (approximately to scale) wherein:

Figure 1:
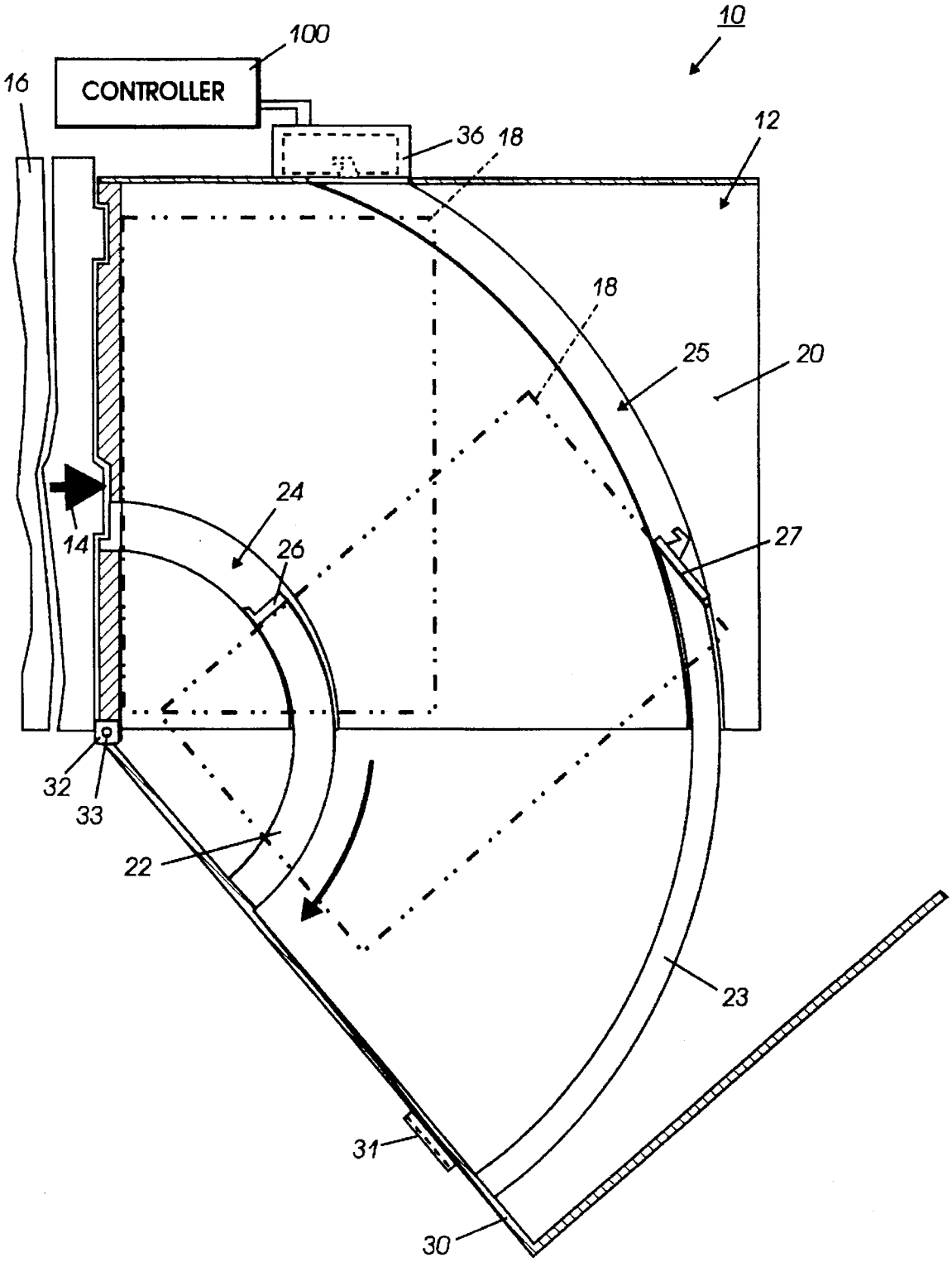
FIG. 1 is one example of a mailbox system in accordance with the present invention in a top view which is cross-sectional to expose an individual mailbox bin which has been unlocked and opened, and also showing in phantom lines both the initial stacking position of the stack of sheets therein and the position of that stack as the bin is so opened.
Figure 2:
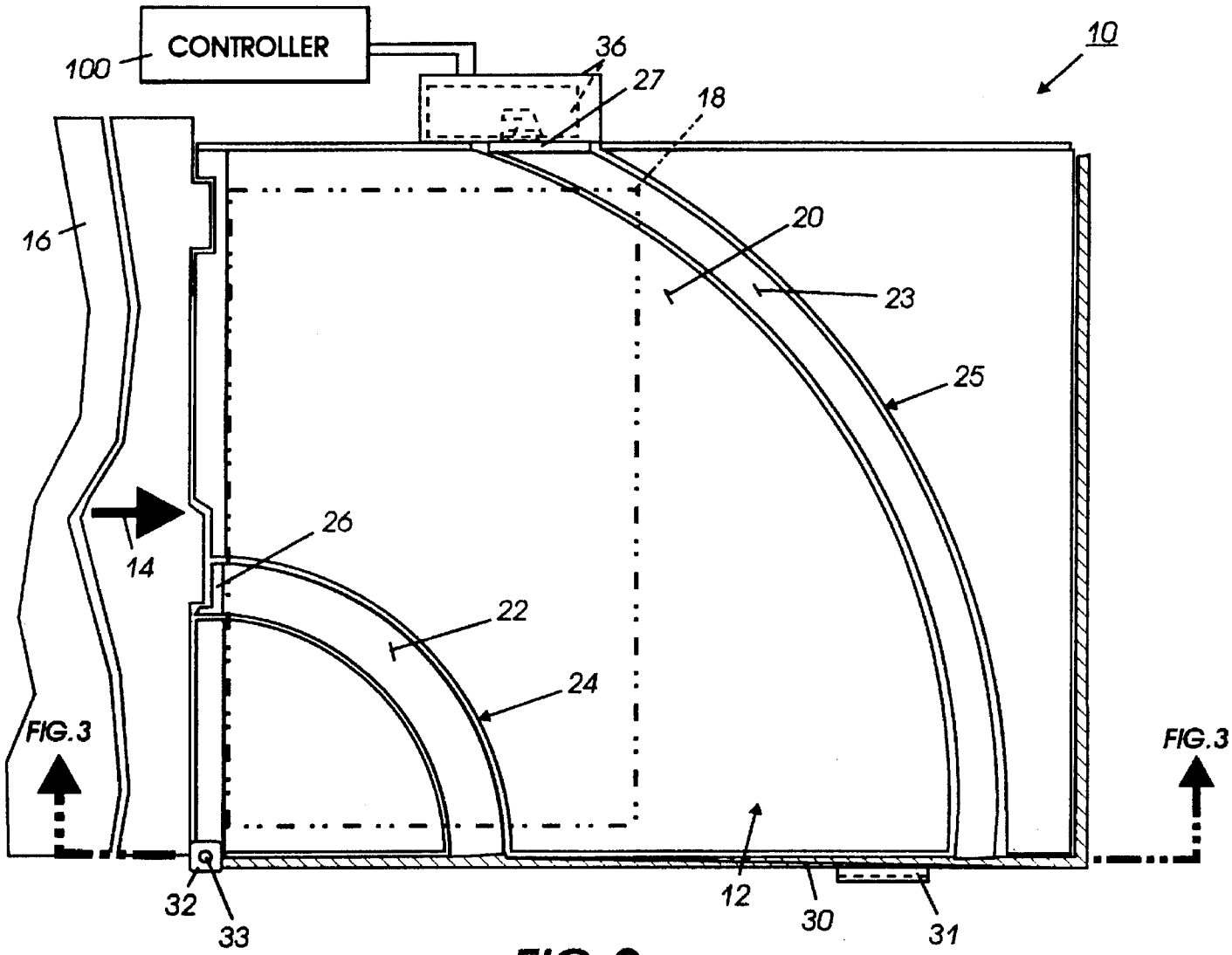
FIG. 2 is the embodiment of FIG. 1 shown with the mailbox bin closed and locked.
Figure 3:
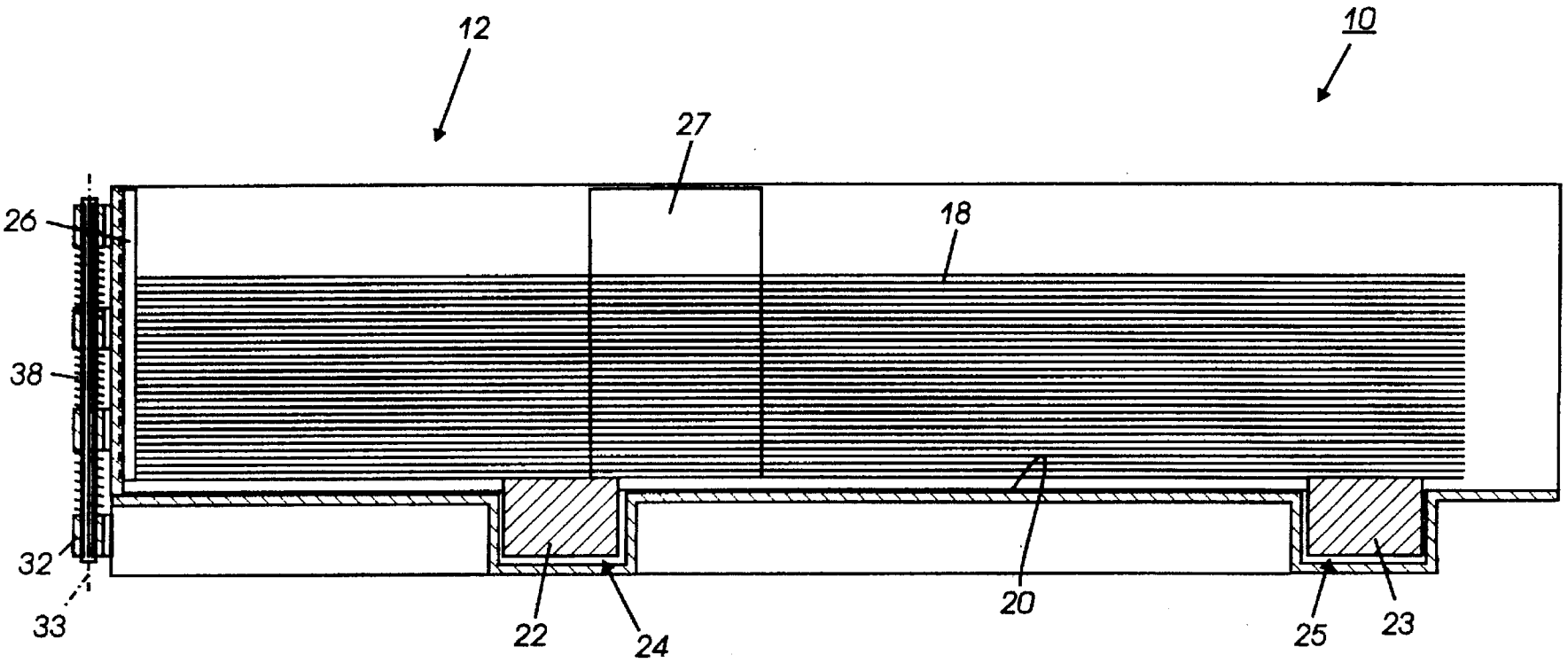
FIG. 3 is a cross sectional view taken along the line indicated in FIG. 2 as "FIG. 3" to provide a cross-sectional frontal view of the embodiment of FIGS. 1 and 2, of a single mailbox bin.
Figure 4:
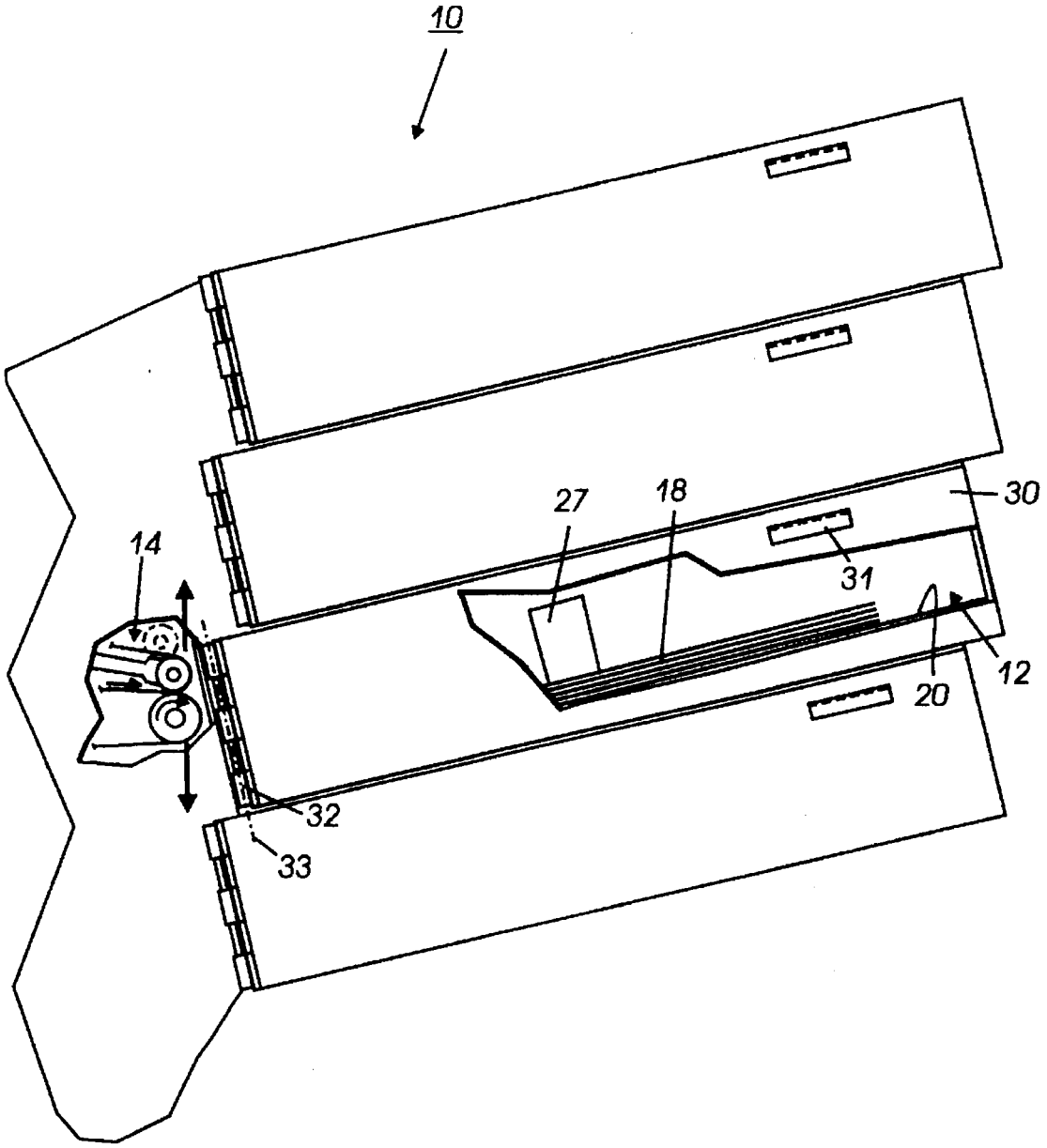
Figure 5:
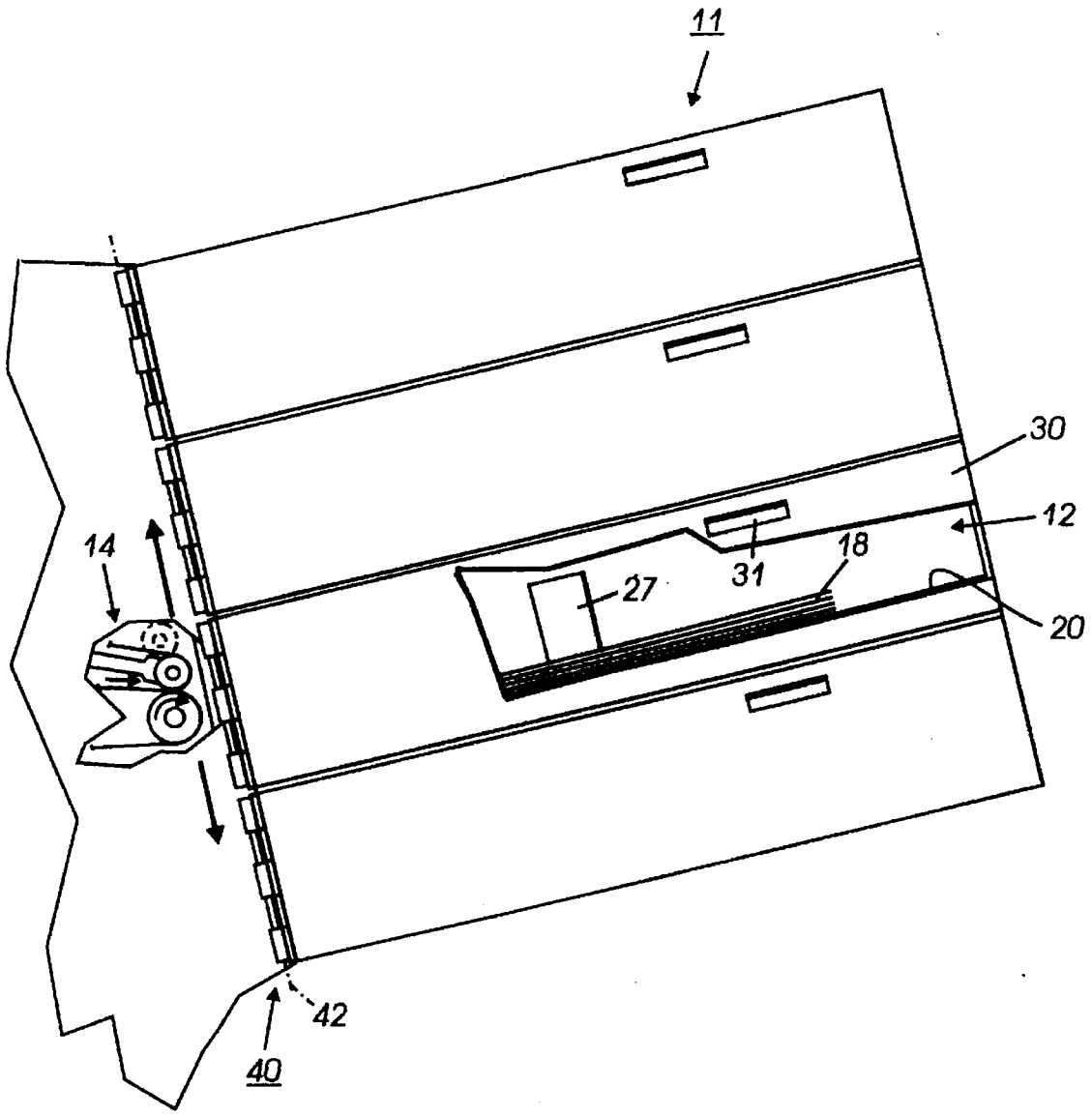

FIG. 4 is a frontal view of the array of multiple mailbox bins of the mailbox system of FIGS. 1–3, with one of the bin doors shown as partially broken away for illustration; and FIG. 5 is an alternative embodiment of the mailbox system of FIGS. 1–4 in which the mailbox bins are superposed at can angle, rather than being directly vertically above one another, to allow for a common pivot axis for the subject mailbox access doors and set exposure and removal systems of the respective bins, as otherwise shown in FIGS. 1–4.

Referring now to the example shown in the Figures, the mailbox system 10 of FIGS. 1–4, or the slightly different mailbox system 11 in FIG. 5, comprise a superposed or substantially vertical array of multiple individual mailbox bins 12. Selected individual bins 12 are fed individual sheets or finished sets of sheets from a sheet input system 14, which may be directly from the output of any printer 16 (such as a shared user centralized printer), directly, or indirectly by a collator and finisher system, as discussed and described in detail in the above-cited Mandel et al patent, etc. Each mailbox bin 12 needs a sheet stacking supporting surface 20 for supporting the sheets as they stack (18) therein, which surface 20 will be substantially horizontal, or may be inclined toward a stacking registration wall within the bin so that the sheets will slide into registration against that wall. These and other details of, and alternatives for, mailbox systems and their operations are already publicly known and need not be described herein. Thus, the following description addresses the specific disclosed features for user print job or job set security, access, and removal.

The stack of sheets 18 shown in phantom in FIGS. 1 and 2, and shown from their front edge in FIGS. 3, 4, and 5, is merely exemplary. In fact, the present set removal system is even more useful for smaller size sheets, the stacks of which would be even harder to retrieve by the conventional method of requiring the operator to reach into the mailbox bin through an access door on only one side, particularly if the set is stacked registered centrally in the mailbox bin, or registered to the rear or side wall of the bin.

The disclosed system 10 or 11 also avoids the disadvantages of prior art systems such as are cited above in which either the entire mailbox bin 12 or the entire sheet stacking supporting surface 20 must be slid out or pulled out of the array of other mailbox bins in the mailbox system. Here, only two narrow sheet supporting rails 22, 23, respectively riding in grooves or tracks 24, 25 in the sheet stacking supporting surface 20, need be moved or pulled out of the mailbox bin when the access door 30 of the bin is unlocked and opened, yet the entire stack of sheets 18 in the mailbox bin is automatically pulled out of the bin and is both freely observable and easily removed by the user without having to reach into the mailbox bin at all.

As shown, both of the sheet supporting rails 22 and 23 may be secured at their front ends directly to the access door 30. The door 30, which may optionally have a handle or pull 31 on the front thereof, is hinge mounted by a front hinge 32 at one side of the door 30, so that the door 30 of each bin pivots about a pivot axis 33 at one side of, and preferably at the front of, the mailbox system array 10 or 11. Thus, when the access door 30 pivots open the sheet supporting rails 22, 23, which are curved to the radius of curvature of the pivot axis 33 at their respective differently spaced distances from the pivot axis 33, also rotate out away from the mailbox bin 12. As they do so they carry thereon, and support thereon, the stack of sheets 18 that was in the mailbox bin 12. This movement of the stack of sheets 18 out of the bin 12 is ensured and assisted by vertical stack extractors or set pulling fingers 26 and 27, respectively extending up from the inside ends of the sheet supporting rails 22, 23. The fingers 26 and 27 are normally respectively flush with the inside end and side walls of the mailbox bin 12, as shown, so as not to interfere with stacking or registration.

Thus, sheets that were stacked well into the interior of the mailbox bin are automatically pivoted out from the mailbox bin, and are fully accessible to the operator for removal when the door 30 opens. It will be appreciated that by "frontal" or frontally accessible is meant any side or end of the combined printer 16 and mailbox system 10 unit which is frontally accessible to the operator, and that may be either the front or side thereof. The hinge 32 and pivot axis 33 may be on either side of the access door 30, on either side of the mailbox bin 12. However, having the pivot axis 33 aligned with one of the registration walls within the bin, as illustrated, is advantageous.

Note that the horizontal surface area of the sheet supporting rails 22, 23 can be substantially smaller than the total area of the sheet stacking supporting surface 20. The spacing therebetween, and the area thereof, is such as to prevent the stacked sheets from falling through between the rails 22, 23 when they are pivoted out from the mailbox bin. However, as shown, the trailing portion of the stack of sheets 18 can remain in, and be supported by, the stack supporting surface 20, i.e., it is not necessary to pull the entire stack out of the bin.

The position or movement of the sheet supporting rails 22, 23, or their vertical fingers 26, 27, may be additionally used for occluding or not occluding optical sensors in their respective open and closed positions. i.e., to provide for bin open and bin closed signals, as further described in said cited Mandel, et al patent.

Note that in the access system disclosed herein that the access door 80 is not just on or overlying one side of the mailbox bin 12. It is the "L"-shaped cover for two connected (at right angles) orthogonal sides of the mailbox bin. Thus, when the access door 30 opens here, the mailbox bin 12 is open from two sides, not just one side, and the job sets therein may be removed either from the front side thereof on which the handle 31 is located and/or from the orthogonal side of the mailbox array. Thus, frontal access is actually provided on two sides with this system.

The mailbox bin 12 here is of the normally locked or secured type in which access to the sheets 18 therein is normally restricted on all sides, and access is normally prevented by a lock, inside the bin. Access to the contents of a bin 12 is provided by a solenoid unlocking system 36 actuated from a controller 100 when the user access code or other bin unlocking signal is provided, as further described in detail in the above-cited Mandel, et al patent, for example. Preferably, a spring loading such as the wrap spring loading 38 on the hinge 32 illustrated here, is provided. Thus, when a lock is released by its solenoid unlocking system 36, the access door 30 of that bin automatically at least partially pops open or becomes ajar. Thus, it may be readily seen by the user that this bin is where his print jobs are located to be removed. The user can then pull the access door 30 of that bin open further (along with the sheet supporting and removal rails 22, 23 connected thereto) by pulling on the handle or pull 31.

Note that with the above-described system, the only moving components are the access door 30 and the two relatively small sheet supporting rails 22, 23. The other components may all be stationary, which is advantageous for a more rigid construction of the array of bins providing the mailbox system 10 or 11. Also, the moving mass of the door 30 and the rails 22, 23 may be substantially less as compared to sliding out or removing an entire mailbox bin. Furthermore, the mounting or tracking mechanism may be much simpler, as clearly illustrated by the difference between this illustrated embodiment and above-cited references thereon. The simple single hinge 32 mounting here (of a known "piano" or other type) is low cost and easy to manufacture. Furthermore, the sheets of the job sets are easier to unload with the present system, because most of two edges of the stack of sheets 18 are exposed, both frontally, toward the operator, and also toward the side or end of the machine.

As noted from the brief description of the figures above, the embodiment of the mailbox system 11 of FIG. 5 has a different arrangement of the mailbox bins. There is a common hinge system 40 on a common pivot axis 42 for all of the bins. This has some structural and manufacturing advantages. It will however be appreciated that in this case it may be desirable for the mailbox sheet input system 14 to move at the same angle from the vertical as the pivot axis 42, to provide common sheet input spacing from the bin entrances, rather than moving the sheet input system 14 directly vertically, as in FIG. 4. (See the respective movement arrows.)

It will be appreciated that, as described in the above-cited Mandel, et al and other references, not all of the mailbox bin array need be locked. The array may include open, unlocked, shared, or even high capacity stacking trays as part of the array. Only security documents, or those documents from users desiring all their documents to have security from reading or removal by others, need be fed into locked mailbox bins.

While the embodiments disclosed herein are preferred, it will be appreciated from this teaching that various alternatives, modifications, variations or improvements therein may be made by those skilled in the art, which are intended to be encompassed by the following claims:

I claim:

1. In a printer mailboxing system with an array of multiple locked mailbox bins in which printed sheet print jobs from a printer are stacked into respective said mailbox bins selectively designated for different respective users of said printer, which mailbox bins are selectively electrically unlockable to provide frontal access for said respective users to their respective mailbox bins for removal of their print jobs from their respective mailbox bins, each said mailbox bin having an access door and a printed sheet stacking and supporting surface, the improvement comprising:

said mailbox bins including a print job removal system for said removal of print jobs from respective said mailbox bins, and a pivotal mounting system individually pivotally mounting said access door and said print job removal system so that said access door and said print job removal system of respective ones of said mailbox bins freely pivotally swing out away from said array of multiple mailbox bins when said mailbox bin is electrically unlocked, to pivot all said print jobs in said mailbox bin out away from said array of multiple mailbox bins for improved said access and removal of said print jobs from said mailbox bin;

wherein said pivotally mounting system of said access door and said print job removal system of said mailbox bins are on a substantially vertical common axis of rotation adjacent one frontal corner of said access door to provide substantially horizontal outward rotation of said access doors and said print job removal system of said mailbox bins.

2. The printer mailboxing system of claim 1 wherein said print job removal system comprises at least a portion of said printed sheet stacking and supporting surface of said mailbox bin which is operatively connected to pivot with said access door.

3. The printer mailboxing system of claim 1 wherein said print job removal system of said mailbox bins includes vertically extending sheet stack extracting surfaces spaced adjacent at least one side of said mailbox bin opposite from said access door when said access door is closed.

4. The printer mailboxing system of claim 1 wherein said access door and said print job removal system of said mailbox bins are spring loaded to automatically partially pivot open from said array of mailbox bins when said mailbox bin is electrically unlocked.

5. The printer mailboxing system of claim 1 wherein said access door includes two orthogonal sides of said mailbox bin.

6. The printer mailboxing system of claim 5 wherein said access door is L-shaped.

* * * * *